US007114354B1

(12) United States Patent
Dremann

(10) Patent No.: US 7,114,354 B1
(45) Date of Patent: Oct. 3, 2006

(54) INTERNALLY ILLUMINATED KNITTING OR CROCHET NEEDLE

(75) Inventor: Monica Dremann, Sherman Oaks, CA (US)

(73) Assignee: Steven Brantley, Las Vegas, NV (US)

( * ) Notice: Subject to any disclaimer, the term of this patent is extended or adjusted under 35 U.S.C. 154(b) by 0 days.

(21) Appl. No.: 11/401,060

(22) Filed: Apr. 10, 2006

(51) Int. Cl.
*D04B 3/02* (2006.01)

(52) U.S. Cl. ..... 66/118; 66/117; 66/1 A

(58) Field of Classification Search ..... 66/118, 66/117, 1 A; 362/555, 119, 120
See application file for complete search history.

(56) References Cited

U.S. PATENT DOCUMENTS 2,344,370 A 3/1944 Shapiro
2,378,544 A * 6/1945 Fosse et al. ..... 66/117
2,748,582 A * 6/1956 Hadler ..... 66/117
5,152,598 A * 10/1992 Schaffer ..... 362/577
6,089,729 A * 7/2000 Chang ..... 362/120
6,325,522 B1 12/2001 Walian
6,862,764 B1 * 3/2005 Ping ..... 7/128

* cited by examiner

*Primary Examiner*—Danny Worrell

(57) ABSTRACT

The present invention is a plastic knitting or crocheting needle incorporating in the shaft one or more light emitting diodes powered by a battery source in a knob end of the needle. In a preferred embodiment, one or more LED's and their wiring are molded in a clear or translucent plastic shaft forming at least a front portion of the length of the needle, optionally having an LED embedded only in the tip or at a distance back from the tip equaling the typical needle crossing distance during knitting.

10 Claims, 4 Drawing Sheets

INTERNALLY ILLUMINATED KNITTING OR CROCHET NEEDLE

BACKGROUND OF THE INVENTION

The present invention relates to illumination of the site of the operation of knitting or crocheting.

Knitting and crocheting are old tasks that have largely been taken over by mechanized production. However, many individuals take care and pride in personally knitting and crocheting pieces by hand. These practices, although centuries old, have consistently been accompanied by the same complaint, a lack of good working light. A person working the long hours required to make substantial progress on a knitting or crocheting project typically requires somewhat better lighting than that required for viewing flat surfaces such as in reading text. A knitter's hands are constantly moving and twisting to pull yarn, move knitting needles, check finished rows for dropped stitches or improper tension, and many other small but critical jobs. As such, a person knitting or crocheting requires light from several directions to adequately illuminate the work field.

Consider the tools of the craft. The crochet hook has a notch at one end for catching loops of yarn and drawing them through stitches. Aluminum, plastic and wood crochet hooks are the most commonly used, and often use the letter system for size marking. They range in diameter from B (2.25 mm) to S (19 mm), the largest, and come in 6" lengths. Straight knitting needles, which come in aluminum, plastic or wood, are the most commonly used. They come in varying diameter sizes, from 0 (2 mm), the smallest, to size 15 (10 mm) and larger; they are sold in pairs, and come in 10" or 14" lengths. There is a point at one end of the needle, and a knob at the other, which prevents stitches from slipping off. For large projects like afghans, or sweaters that can be worked in a tube without a seam, circular knitting needles can be used. These are long flexible needles with points at both ends.

Some efforts have been made to provide lighting closely associated with knitting needles. U.S. Pat. No. 2,344,370 describes a knitting needle with a plastic core and a metal sheath leaving ends of the knitting needle exposed. An enclosure is applied to the end distal to the tip so that a light bulb is directed to the top of the plastic core. Light is conducted through the plastic core to provide a low level glow from the exposed tip. The level of illumination is extremely limited and a user is required to keep the end of the device plugged in to an electrical outlet.

U.S. Pat. No. 6,325,522 describes a crochet hook inserted at its straight end into a handle assembly where illumination shines along the exposed shaft of the crochet hook. Unfortunately, this device is without beneficial effect as soon as a user grasps the exposed shaft and blocks the light. Such an action is taken often in knitting and crocheting to adjust the current row of stitches.

There is a need for a device that provides adequate lighting for a person performing hand knitting or crocheting that is closely associated with the knitting needles or crochet hooks.

SUMMARY OF THE INVENTION

The present invention comprises a plastic knitting or crocheting needle incorporating in the shaft one or more light emitting diodes powered by a battery source in a knob end of the needle. In a preferred embodiment, one or more LED's and their wiring are molded in a clear or translucent plastic shaft forming at least a front portion of the length of the needle, optionally having an LED embedded only in the tip or at a distance back from the tip equaling the typical needle crossing distance during knitting.

At least the front portion of the shaft of the invention needles are formed of a clear or translucent material such as clear or translucent polymers. It is an intent of the invention to provide light sources at critical locations along the length the knitting or crocheting needles so that the working field is primarily illuminated from the inside out. In one form, a single white or colored LED is located as near to the needle tip as practicable to preserve the required conic surface of the needle tip. Current packages of LED's will permit such a tip LED to be located very close to a knitting needle tip, i.e., within about 5 millimeters or less.

Conventional LEDs are made from a variety of inorganic minerals, producing the following colors: aluminium gallium arsenide (AlGaAs)—red and infrared; gallium aluminium phosphide (GaAIP)—green; gallium arsenide/phosphide (GaAsP)—red, orange-red, orange, and yellow; gallium nitride (GaN)—green, pure green (or emerald green), and blue; gallium phosphide (GaP)—red, yellow and green; selenide (ZnSe)—blue; indium gallium nitride (InGaN)—bluish-green and blue; indium gallium aluminium phosphide (InGaAIP)—orange-red, orange, yellow, and green; silicon carbide (SiC) as substrate—blue; diamond (C)—ultraviolet; sapphire (Al2O3) as substrate—blue.

In addition, bicolor LED's are packaged so that two colors may alternately be activated to shine from the same LED package, i.e., red and green for example. Very bright, high intensity white LED's with exceptional efficiency have been developed in recent years, and white color LED's are well known in the art.

The present invention allows a user to choose from one of many shaft locations, colors and light intensities for LED's embedded or located in the shaft of a knitting or crocheting needle. The many hours a user spends in the knitting or crocheting tasks cause a user to seek out places and devices reducing eye strain and improving comfort in viewing the work field. For example, a user may prefer a white, high intensity LED to be located in a knitting needle used to receive stitches so that the user's palm will shield the user's eyes from direct view but permit the reflected light to illuminate the background of the work field and allow the user to manipulate that same needle to temporarily brightly illuminate any surface around the user when the user's palm is removed from its covering position. A user may choose to have only a low intensity blue LED at the tip of the needle used to form the stitches so that the user can easily follow the path of the needle tip into an newly formed loop on the needle bearing the stitches.

It is an object of the present invention to essentially illuminate the work field for knitting or crocheting from the inside out so the user can move their hands, fingers, needles and yarn without blocking field illumination.

It is another object of the invention to provide point light sources within the clear or translucent shafts of knitting or crochet needles to provide illumination of the work field.

It is yet another object of the invention to provide a removable illuminated core for a range of knitting needles of multiple diameters.

DETAILED DESCRIPTION OF THE INVENTION

The invention is now discussed with reference to the figures.

Figure 1:
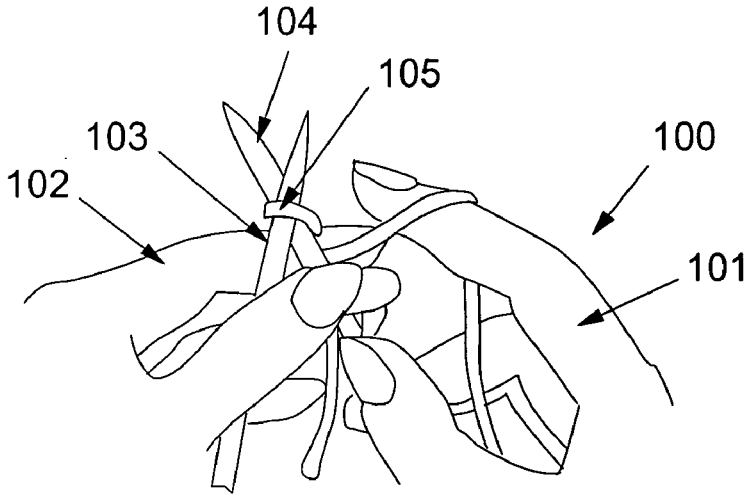
FIG. 1 PRIOR ART
FIG. 1 is a user's view of the hands of a person knitting using two knitting needles.

FIG. 1 shows a view of a person's hands 100 engaged in knitting, with right hand 101 grasping right needle 104 and left hand grasping left needle 103. Loop 105 has been formed by way of insertion of the tip of right needle 104 into yarn engaged on left needle 103. It may be easily appreciated that light must be directed from several sources to adequately light the work field for a user.

Figure 2:
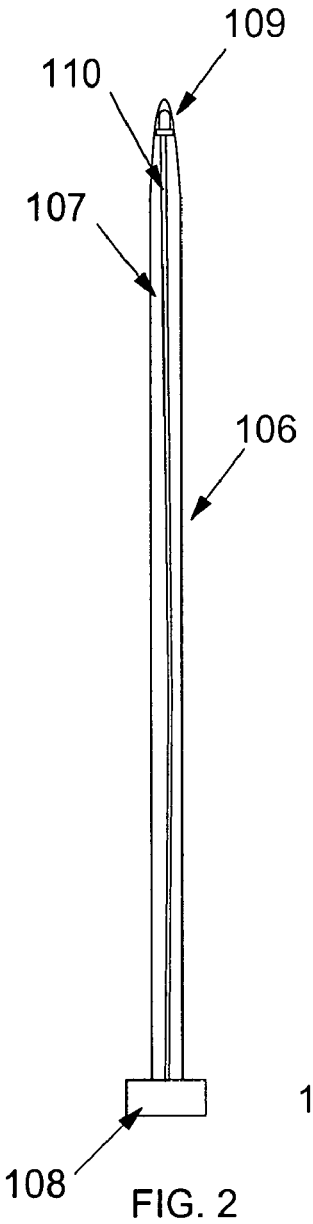
FIG. 2 is a side view of an embodiment of an invention knitting needle with an LED embedded or located in the tip of the needle.

FIG. 2 shows an embodiment of the invention knitting needle 106 having a knob 108 rigidly connected to a proximal end of shaft 107, which extends to a pointed tip. Within the section of said tip, an LED 109 is located or embedded near to said tip and oriented so that its light emissions are effectively dispersed by the clear or translucent polymer material of shaft 107. Wires 110 connect the electrical connections of LED 109 with electrical connections for battery power and switch means for activating the battery to power LED 109. FIG. 2 provides a single LED, which may be selected from any of several colors and lighting intensities to provide illumination to the topmost zone in a work field of a person knitting, i.e., at the top of the needles. It is an option of the invention to provide a set of knitting needles where only one of said knitting needles bears LED's or light sources in its shaft.

Figure 3:
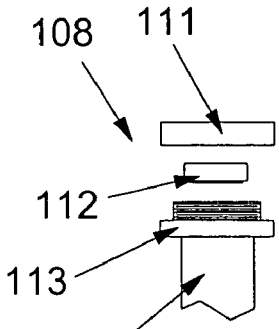
FIG. 3 is a side, exploded view of the knob end of the needle of FIG. 2.
Figure 4:
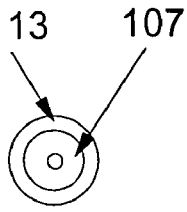
FIG. 4 is a bottom view of the needle of FIG. 2.
Figure 5:
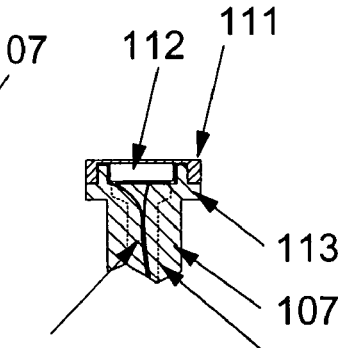
FIG. 5 is a side, cutaway view of the knob end of the needle of FIG. 2.

FIG. 3 is a side view of knob 108 which comprises a threaded cap that is adapted to engage threaded battery housing 113, which cooperate to securely hold battery 112. FIG. 4 is a bottom view of needle of FIG. 2 showing shaft 107 and an underside of battery housing 113. FIG. 5 shows one form of the switching means for the LED's of the invention where wires 110 extend to positive and negative terminals of battery 112. Broken lines 114 indicate the location of an optional, cylindrical bore in shaft 107 which will allow the LED's of the invention and wires therefor to be inserted to a distance desired for the objects of the invention.

Figure 6:
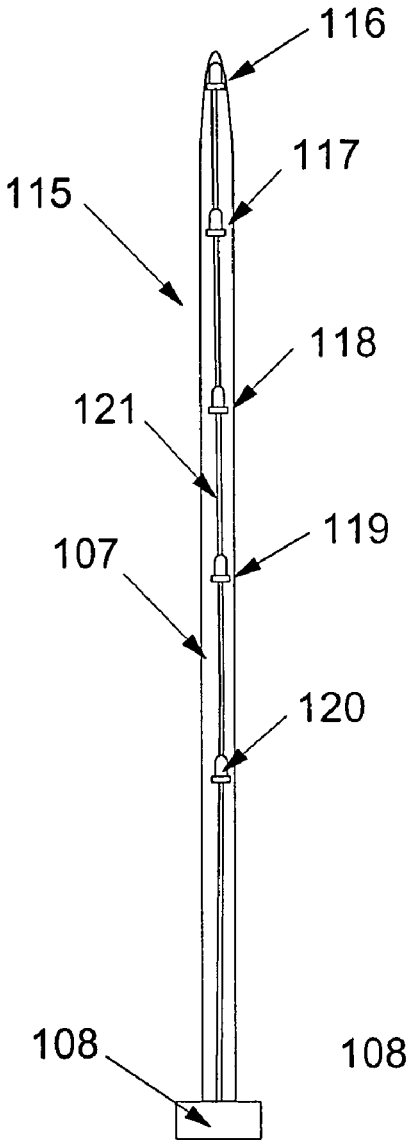
FIGS. 6, 7 and 8 are side views of alternate embodiments of the invention knitting needle of FIG. 2.

FIG. 6 shows an alternate embodiment of the invention needle 115 wherein LED's 116 through 117 are fixed at intervals along the length of shaft 107. LED 116 is located at the tip of shaft 107. LED 117 is located at a distance away from the tip so that it will most likely not pass under the other knitting needle in the knitting operation. More specifically, one knitting needle is typically moved under one that bears a row of stitches. In this example, the needle moved under the other is more efficiently deployed if a user can see LED 117 as an indication of when to stop moving that needle in a forward direction under the other knitting needle. LED's 118, 119 and 120 provide additional illumination for counting stitches in a row of stitches on a shaft 107. Wires 121 connect LED's 116 through 118 to battery power and switching means in knob 108. Switch means include switches capable of causing any one, two, three, four or five of the LED's to become lighted.

Figure 7:
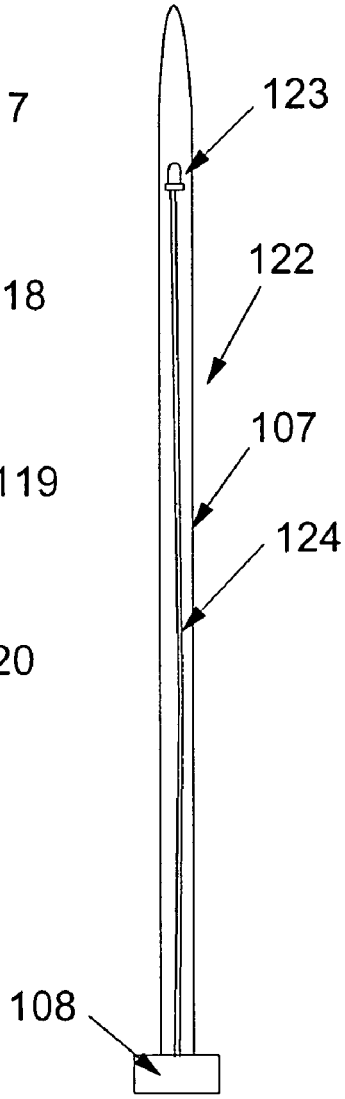

FIG. 7 shows an alternate embodiment of the invention needle 122 wherein an LED 123 is located along the length of shaft 107 alone in about the location of LED 117 of the knitting needle of FIG. 6. Wires 124 connect LED 123 with battery power and switch means.

Figure 8:
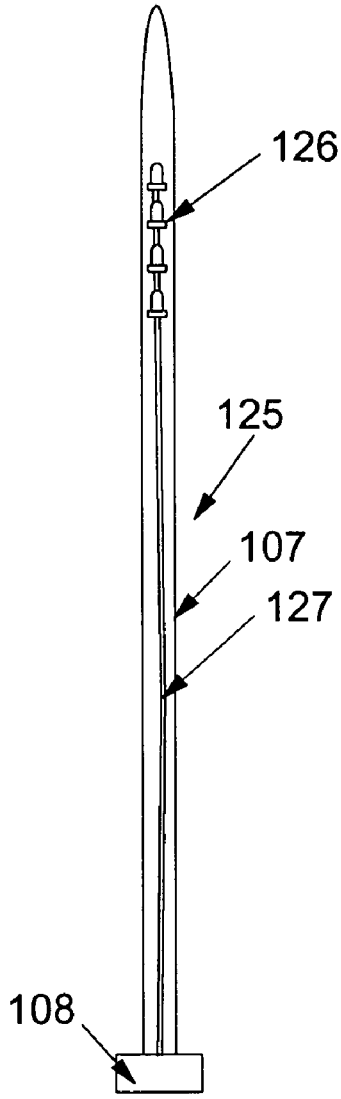

FIG. 8 shows an alternate embodiment of the invention needle 125 wherein a group of LED's 126 are located close together to provide a relatively unified illumination source for greater light levels and even lighting of a work field.

Figure 9:
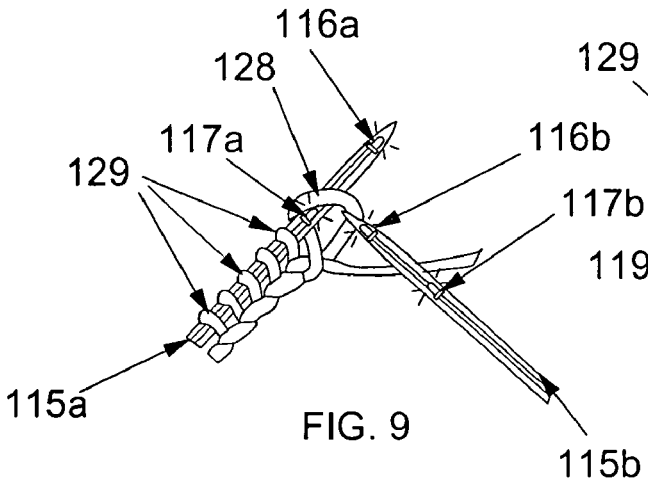
FIG. 9 is a user's view of two invention knitting needles where one needle is initiating a stitch.
Figure 10:
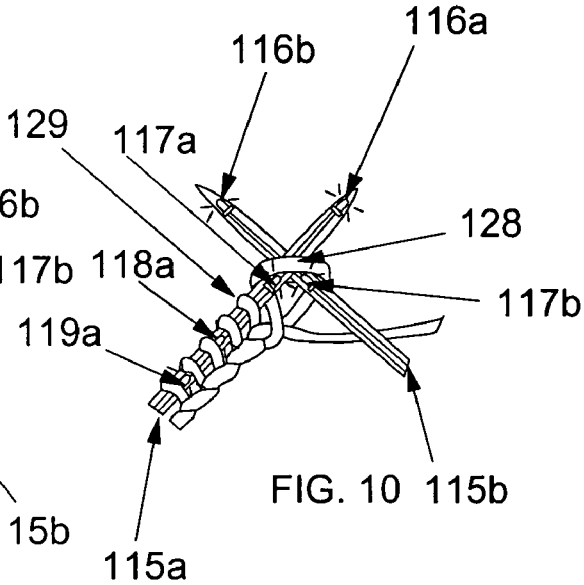
FIG. 10 is the view of FIG. 9 where the user has inserted one needle into a loop and under the other needle.

FIG. 9 shows left needle 115*a* bearing a number of stitches 129 and a loop 128 being initiated by a tip of right needle 115*b*. LED's 117*a* and 116*b* illuminate virtually all of the required work field for a user to see the yarn and needle surfaces needed for forming the loop 128. LED 116*a* provides an "umbrella" lighting generally downward from a highest point in the work field. In FIG. 10, right needle 115*b* has been moved under left needle 115*a* and through loop 129 just before the location of LED 117*b*. FIGS. 9 and 10 illustrate two of the most important and basic motions taken during knitting, i.e., forming a loop and completing a stitch. LED's 116*a*, 116*b*, 117*a* and 117*b* cooperate to make these basic tasks fully and internally illuminated.

Figure 11:
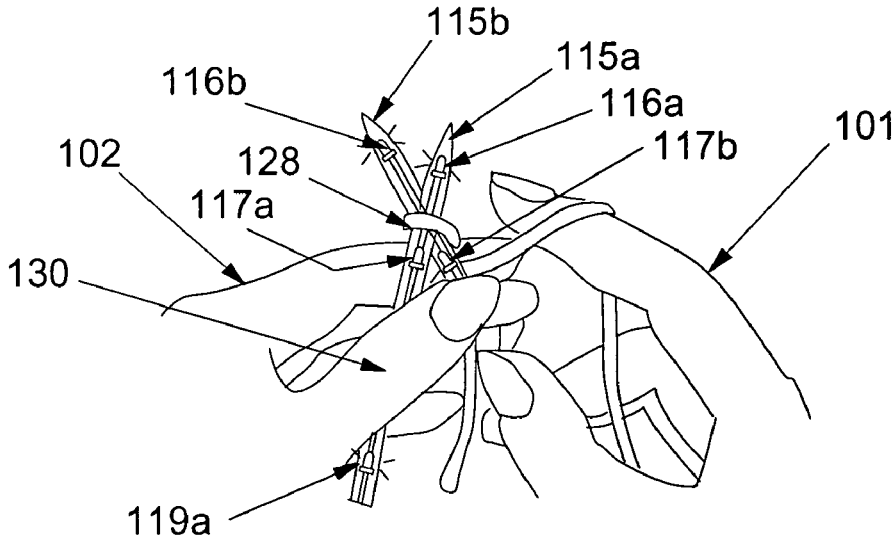
FIG. 11 is the view of FIG. 10 with a user's hands supporting the knitting needles and yarn.

FIG. 11 shows how a user's hands 101 and 102 in the action of FIG. 10 appear engaged with the invention knitting needles 115*a* and 115*b*. A user's thumb and inner palm cover LED 118*a* (not shown). LED's in that location will not shine into a user's eyes but instead provide indirect, reflected light if so desired by a user.

Figure 12:
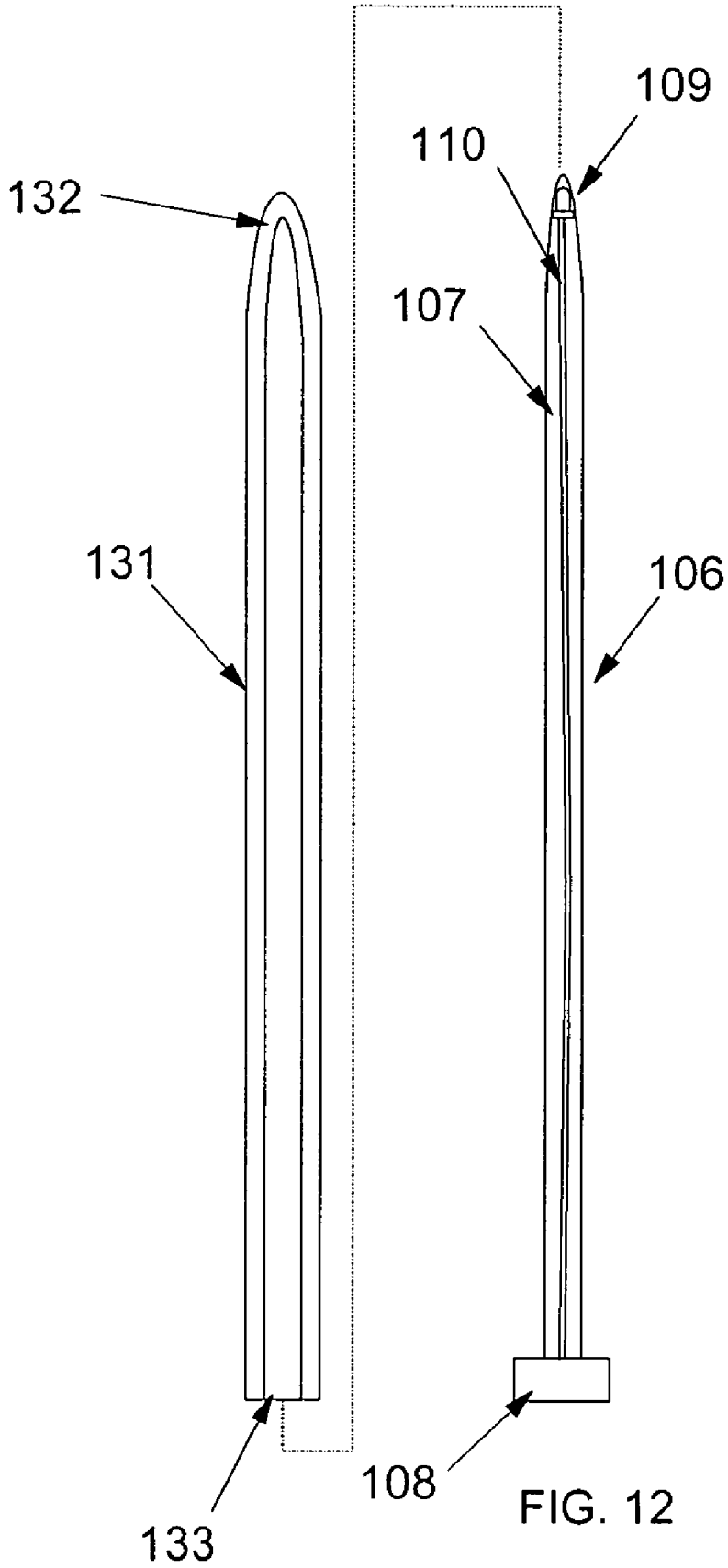
FIG. 12 is a side view of the knitting needle of FIG. 2 with a clear or translucent sheath increasing the effective diameter of the invention knitting needle.

FIG. 12 shows the knitting needle 106 of FIG. 2 with a clear or translucent cylindrical sleeve or sheath 131 having a cylindrical bore 133 with a diameter just larger than that of shaft 107, an opening at a lower end and ending just before the tip 132. The outer diameter of sheath 131 is one or more standard diameters of knitting needles above that of shaft 107. Said opening of bore 133 is adapted to receive the tip of shaft 107 and to be fully inserted therein. A user may then purchase only a single needle 106 with additional sheaths 131 to be provided with all standard sizes of knitting needles.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A knitting or crochet needle formed from a long, cylindrical shaft having a standard diameter and formed of a clear or translucent polymer at a lighted section of the shaft, said needle further having a tip end and a knob end comprising:

(a) one or more light emitting diodes located in or embedded in the clear or translucent polymer part of the lighted section of the shaft;

(b) electrical wires connecting said light emitting diodes to a battery power source located in the knob end; and (c) switch means for turning on or off the light emitting diodes.

2. The knitting or crochet needle of claim 1 wherein a single light emitting diode is embedded in the needle, which is located close to the tip end.

3. The knitting or crochet needle of claim 2 wherein a forward end of the single light emitting diode is located 10 millimeters or less from the tip end.

4. The knitting or crochet needle of claim 1 wherein a single light emitting diode is embedded in the needle, which is located distal from the tip end at a distance greater than that whereby a user would stop in a forward motion moving one knitting needle under another to form a stitch.

5. The knitting or crochet needle of claim 4 wherein a forward end of the single light emitting diode is located 10 to 50 millimeters from the tip end.

6. The knitting or crochet needle of claim 1 wherein two or more light emitting diodes are spaced apart by about 10 to 20 millimeters and embedded in the needle so that a forward light emitting diode is located close to the tip end.

7. The knitting or crochet needle of claim 1 wherein a clear or translucent cylindrical sheath with a cylindrical bore whose diameter is about that of the shaft has an outside diameter of a next standard size up from the diameter of said needle.

8. The knitting or crochet needle of claim 1 wherein two or more light emitting diodes are located adjacent to each other where a forward most light emitting diode is located at least 10 millimeters back from the tip.

9. A pair of craft needles, each formed from a long, cylindrical shaft having a standard diameter and formed of a clear or translucent polymer at a lighted section of the shaft, said each needle further having a tip end and a knob end comprising:

(a) two light emitting diodes are located in or embedded in the clear or translucent polymer part of the lighted section of the shaft spaced apart by about 10 to 20 millimeters so that a forward light emitting diode is located close to the tip end;

(b) electrical wires connecting said light emitting diodes to a battery power source located in the knob end; and (c) switch means for turning on or off the light emitting diodes.

10. A knitting or crochet needle formed from a long, cylindrical shaft having a standard diameter and formed of a clear or translucent polymer at a lighted section of the shaft, said needle further having a tip end and a knob end comprising:

(a) one or more light emitting diodes located in or embedded in the clear or translucent polymer part of the lighted section of the shaft;

(b) electrical wires connecting said light emitting diodes to a battery power source located in the knob end;

(c) switch means for turning on or off the light emitting diodes; and (d) one or more of the light emitting diodes are selected from those that emit the colors blue, green, red alternating with green, red, yellow, or orange.

* * * * *

UNITED STATES PATENT AND TRADEMARK OFFICE

CERTIFICATE OF CORRECTION

PATENT NO. : 7,114,354 B1
APPLICATION NO. : 11/401060
DATED : October 3, 2006
INVENTOR(S) : Monica Dremann It is certified that error appears in the above-identified patent and that said Letters Patent is hereby corrected as shown below:

Title Page, Left Column, Line 73:
"Assignee: Brantley; Steven (Las Vegas, NV) US" should read -- Assignee: Widget Products, Inc. (Las Vegas, NV) US --

Signed and Sealed this

Tenth Day of April, 2007

JON W. DUDAS
*Director of the United States Patent and Trademark Office*